US009676110B2

(12) United States Patent
Lau

(10) Patent No.: US 9,676,110 B2
(45) Date of Patent: Jun. 13, 2017

(54) CONCAVED CUTTER HEAD ASSEMBLY FOR HAIR TRIMMER

(71) Applicant: SPECIALIFE (ZHUHAI) CO., LTD., Guangdong Province (CN)

(72) Inventor: Tung Yan Lau, Guangdong Province (CN)

( * ) Notice: Subject to any disclaimer, the term of this patent is extended or adjusted under 35 U.S.C. 154(b) by 181 days.

(21) Appl. No.: 14/184,734

(22) Filed: Feb. 20, 2014

(65) Prior Publication Data

US 2014/0259689 A1 Sep. 18, 2014

(30) Foreign Application Priority Data

Mar. 15, 2013 (CN) ..... 2013 1 0083247

(51) Int. Cl.
*B26B 19/02* (2006.01)
*B26B 19/04* (2006.01)
*B26B 19/38* (2006.01)

(52) U.S. Cl.
CPC ..... *B26B 19/3846* (2013.01)

(58) Field of Classification Search
CPC ..... B26B 19/3846; B26B 21/12; B26B 19/10; B26B 19/32
USPC ..... 30/30, 241, 242, 243, 272.1, 228, 32, 30/29.5, 43.92, 43
See application file for complete search history.

(56) References Cited

U.S. PATENT DOCUMENTS

| | | | | | |
|---|---|---|---|---|---|
| 1,471,970 | A * | 10/1923 | McElroy | 30/30 | |
| 2,704,887 | A * | 3/1955 | Andis | 30/210 | |
| 2,713,718 | A * | 7/1955 | Hudson | 30/200 | |
| 4,221,050 | A * | 9/1980 | Walter et al. | 30/216 | |
| 4,498,237 | A * | 2/1985 | Mack et al. | 30/200 | |
| 4,813,133 | A * | 3/1989 | Locke et al. | 30/215 | |
| 5,575,069 | A * | 11/1996 | Roberto Kneeland | B26B 19/06 | 30/199 |
| 5,937,526 | A * | 8/1999 | Wahl et al. | 30/201 | |
| 8,123,332 | B2 * | 2/2012 | Morgan et al. | 347/33 | |
| 2001/0029669 | A1 * | 10/2001 | Ferraro et al. | 30/49 | |
| 2008/0052914 | A1 * | 3/2008 | Bednar | B26B 19/02 | 30/216 |
| 2011/0131790 | A1 * | 6/2011 | Chien | 29/557 | |

* cited by examiner

*Primary Examiner* — Stephen Choi
*Assistant Examiner* — Fernando Ayala
(74) *Attorney, Agent, or Firm* — Prakash Nama; Global IP Services, PLLC

(57) ABSTRACT

A concaved cutter head assembly for hair trimmer comprising a fixed blade, a movable blade and a slot support fixed to the fixed blade; the fixed blade and the movable blade comprise a fixed blade toothed edge and a movable blade toothed edge respectively; the movable blade toothed edge is driven to move reciprocally along slots on the slot support with respect to the fixed blade toothed edge to form a cutting surface; a fixed blade seat is also provided, whereas one end of which is provided with a protective cover; a frontal edge of the protective cover is positioned in front of the fixed blade toothed edge; the fixed blade toothed edge, the movable blade toothed edge, the slots and the frontal edge of the protective cover are all concave arcs, and all these concave arcs are concentric with respect to one another.

8 Claims, 5 Drawing Sheets

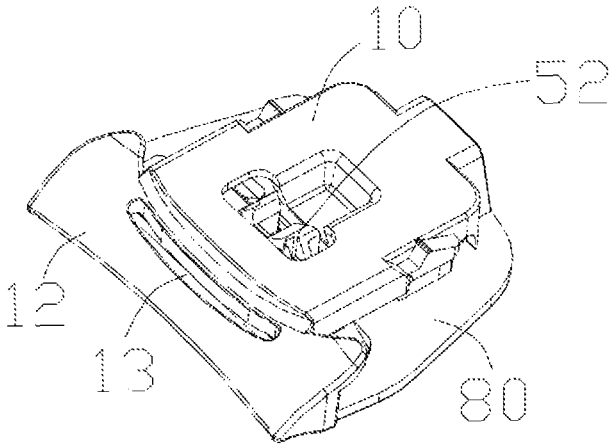
FIG.1A
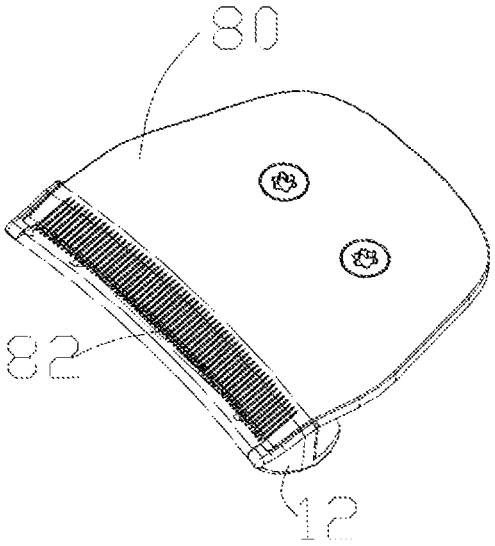
FIG.1B
FIG.1

CONCAVED CUTTER HEAD ASSEMBLY FOR HAIR TRIMMER

BACKGROUND OF THE INVENTION

The present invention relates to the technical field of personal care products, and more specifically relates to a concaved cutter head assembly for hair trimmer.

Conventionally, each of the various kinds of hair trimming devices such as shavers, nostril trimmers, hair clippers or other small cutting tools for personal hygiene and daily care has a linear cutting edge. However, as it is difficult for the linear cutting edge to move closely along the skin surface, the linear cutting edge can easily cut and hurt the skin and hairs may not be completely trimmed as desired, for instance in cases where the hairs to be trimmed are very short, or where a shaved head is required, or where hairs to be trimmed are on an uneven skin surface.

BRIEF SUMMARY OF THE INVENTION

In view of the aforesaid disadvantages now present in the prior art, the present invention provides a new kind of hair trimmer suitable for shaving a shaved head, trimming very short hairs and trimming hairs on uneven skin surface.

The present invention adopts the following technical proposal:

A concaved cutter head assembly for hair trimmer comprises a fixed blade and a movable blade stacked up and mutually fixed in position with respect to each other; the concaved cutter head assembly for hair trimmer also comprises a slot support disposed between the fixed blade and the movable blade and fixed to the fixed blade; the fixed blade and the movable blade comprise a fixed blade toothed edge and a movable blade toothed edge respectively and each of the fixed blade toothed edge and the movable blade toothed edge is constituted by a multiple number of consecutively arranged small teeth each having a cutting edge on each of its two sides; the movable blade toothed edge is concealed by the fixed blade toothed edge; the movable blade is driven so that the movable blade toothed edge moves reciprocally along slots on the slot support with respect to the fixed blade toothed edge to form a cutting surface; the fixed blade toothed edge, the movable blade toothed edge, the slots and the cutting surface are all concave arcs in terms of their shape, and all these concave arcs are concentric with respect to one another; the concaved cutter head assembly for hair trimmer also comprises a fixed blade seat; the fixed blade seat is positioned corresponding to the fixed blade; the movable blade and the slot support are disposed between and accommodated within a space between the fixed blade seat and the fixed blade; one end of the fixed blade seat corresponding to the fixed blade toothed edge is provided with a protective cover for protecting the fixed blade toothed edge and for stretching and smoothing skin surface before the movable blade starts hair cutting and trimming; a frontal edge of the protective cover is positioned in front of the fixed blade toothed edge; the fixed blade toothed edge, the movable blade toothed edge, the slots and the frontal edge of the protective cover are all concave arcs in terms of their shape, and all these concave arcs are concentric with respect to one another.

Radius of a respective concave arc of the frontal edge of the protective cover is smaller than radius of a respective concave arc of the fixed blade toothed edge, the radius of the respective concave arc of the fixed blade toothed edge is smaller than radius of a respective concave arc of the movable blade toothed edge, the radius of the respective concave arc of the movable blade toothed edge is smaller than radius of a respective concave arc of the slots.

The concaved cutter head assembly for hair trimmer also comprises a movable blade rack accommodated within the space between the fixed blade seat and the fixed blade and fixed on a second side of the movable blade opposing to a first side of the movable blade which faces towards the slot support; fixing holes are provided on the movable blade; the movable blade rack is provided with mounting columns; the mounting columns pass through the fixing holes and extend into the slots on the slot support; the movable blade rack is driven to drive the movable blade toothed edge to move reciprocally along the slots with respect to the fixed blade toothed edge.

A motion actuating rod is disposed on a surface of the movable blade rack; an opening is provided on the fixed blade seat at a position corresponding to where the motion actuating rod is positioned; the motion actuating rod is exposed via the opening; width of the opening is larger than width of the motion actuating rod so that on one hand the motion actuating rod is capable of moving reciprocally within a given range when it is driven, and on the other hand two ends of the movable blade will not be moved past two ends of the fixed blade and will not be exposed therefrom when the motion actuating rod drives the movable blade toothed edge to move reciprocally along the slots with respect to the fixed blade toothed edge.

The concaved cutter head assembly for hair trimmer also comprises a spring and a blade pressing rack within the space between the fixed blade seat and the fixed blade; one end of the spring is fixed to another end of the fixed blade seat opposite to the cutting surface via a spring shaft; another end of the spring presses the movable blade tightly against the fixed blade via the blade pressing rack so as to prevent hairs from slipping into any space between the movable blade and the fixed blade.

Juxtaposed tips of both the small teeth of both the fixed blade toothed edge and the movable blade toothed edge are all pointing forward towards one and the same direction; the small teeth are not symmetrical.

Thickness of the fixed blade toothed edge is not more than 0.3 mm.

A washing hole is provided on the fixed blade seat near to the cutting surface to allow inlet of water so as to wash and clean the cutting surface.

As compared with the existing prior art, the present invention has the following advantages:

1. The movable blade, the fixed blade, the frontal edge of the protective cover and the path of movement at the cutting surface are all concave arcs in terms of shape, and all these arcs are concentric. Accordingly, movement at the cutting surface of the entire cutting head assembly is ensured to be smooth, a depth is fixed in the cutter head assembly where trimming by the blades is performed, hair trimming effect is optimized, and the tips of the small teeth of the movable blade are kept behind the tips of the small teeth of the fixed blade so as not to cut and hurt the skin.

2. All the tips of the small teeth point forward to one and the same direction; therefore, the teeth are arranged in parallel; as such, the teeth can be made at a low production cost by a single procedure using a milling wheel or a grinding wheel.

3. The protective cover can stretch and straighten the skin before cutting and trimming to ensure no bulging skin so as to prevent the skin from being cut and hurt if it bulges.

BRIEF DESCRIPTION OF THE DRAWINGS

FIG. 1A is a front perspective view of the overall structure of the present invention.

FIG. 1B is a rear perspective view of the overall structure of the present invention.

DETAILED DESCRIPTION OF THE INVENTION

Figure 2:
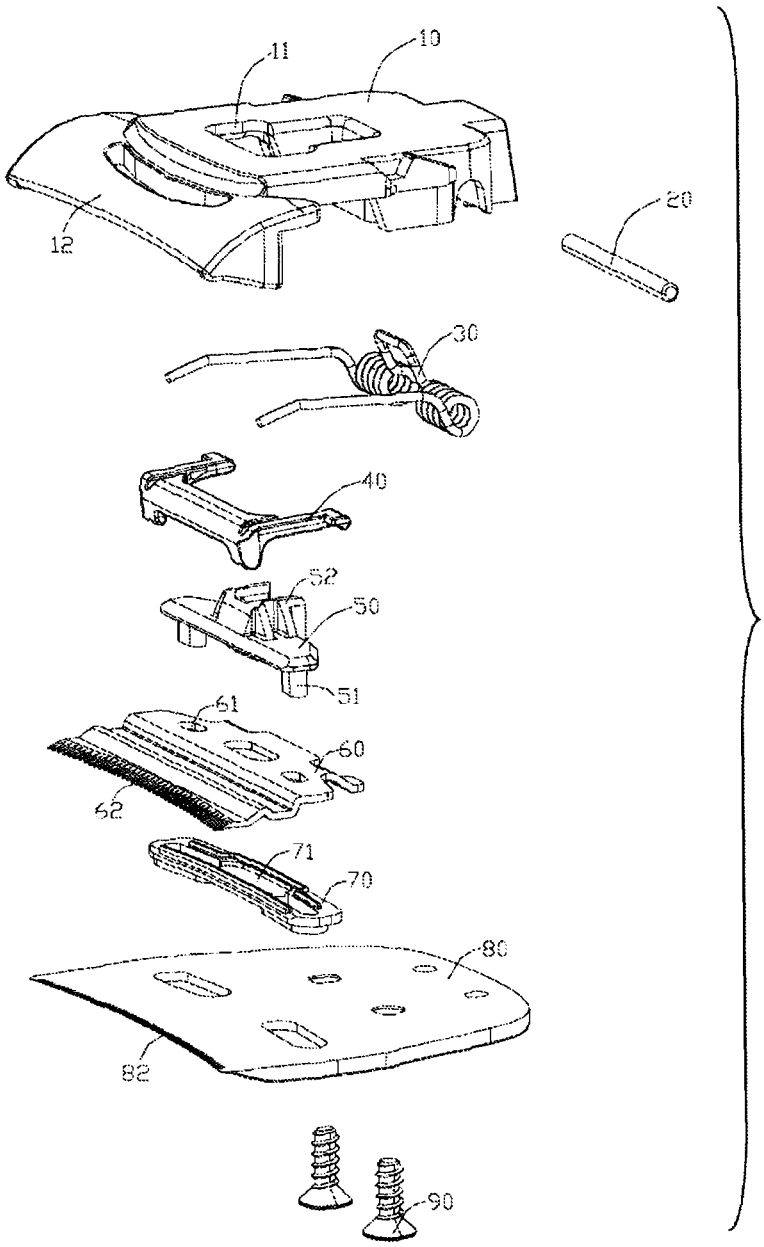
FIG. 2 is an exploded view showing the structure of the present invention.
Figure 3:
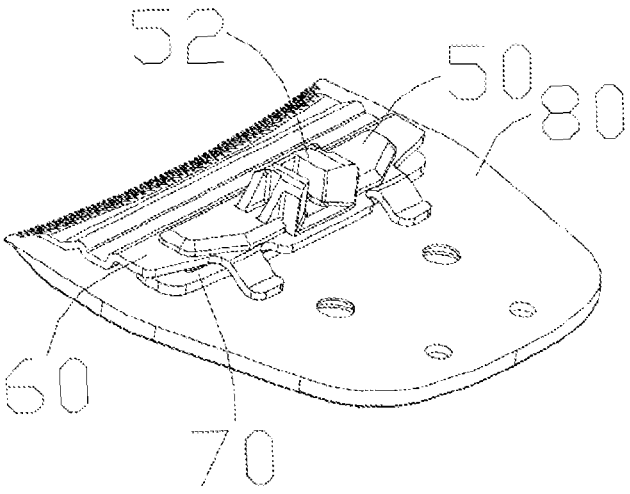
FIG. 3 is a structural view showing the movable blade and the fixed blade of the present invention connected with each other.
Figure 4:
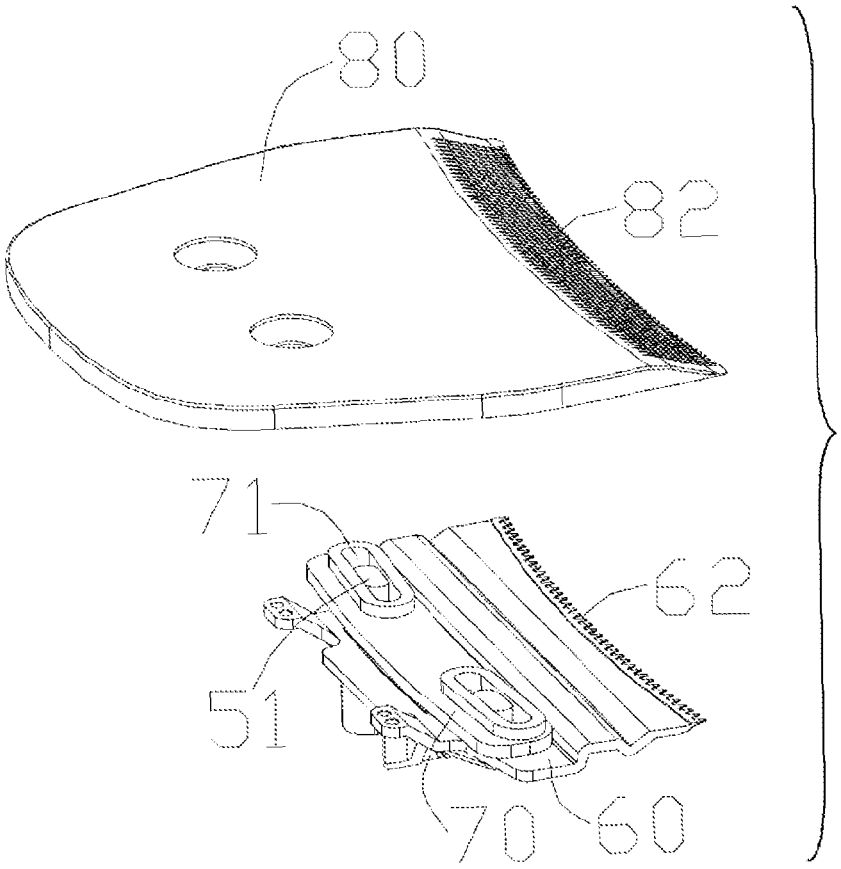
FIG. 4 is a structural view showing the movable blade, the fixed blade and the slot support of the present invention.
Figure 5:
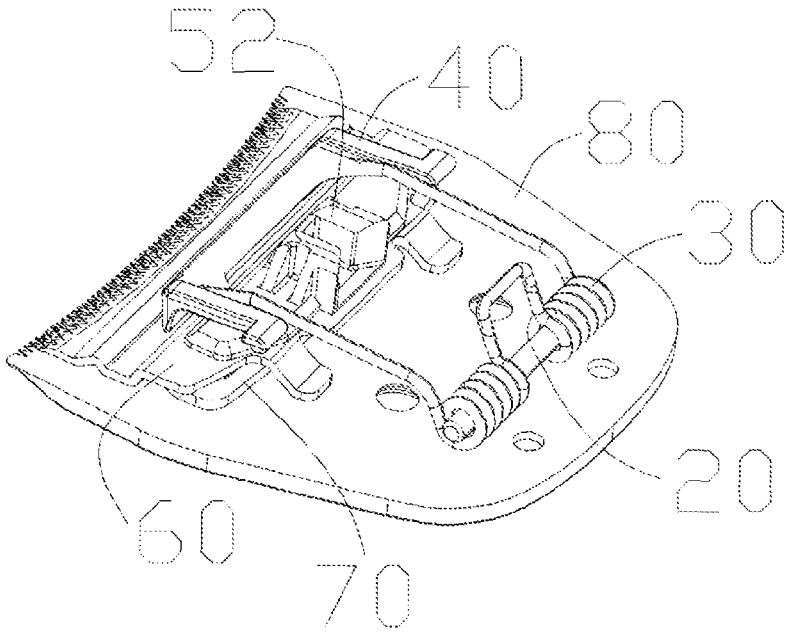
FIG. 5 shows the structure of the concaved cutter head assembly for hair trimmer according to the present invention without the fixed blade seat.
Figure 6:
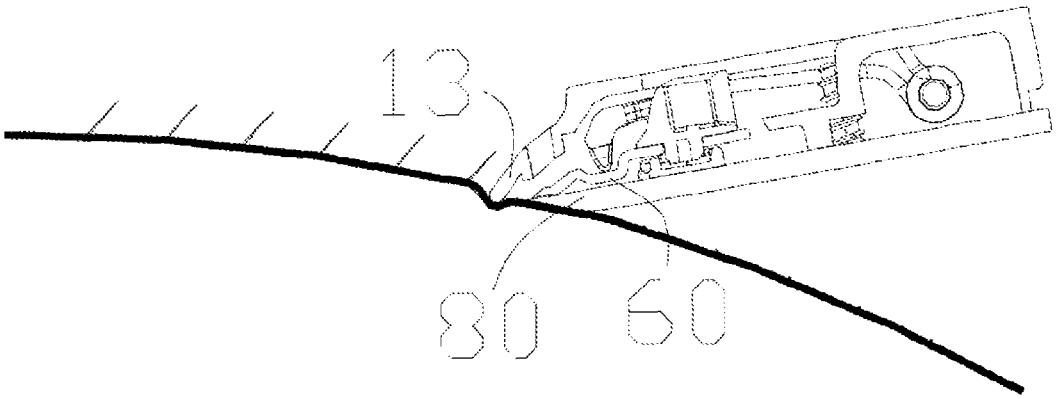
FIG. 6 shows the concaved cutter head assembly for hair trimmer according to the present invention when it is used for cutting and trimming hairs.
Figure 7:
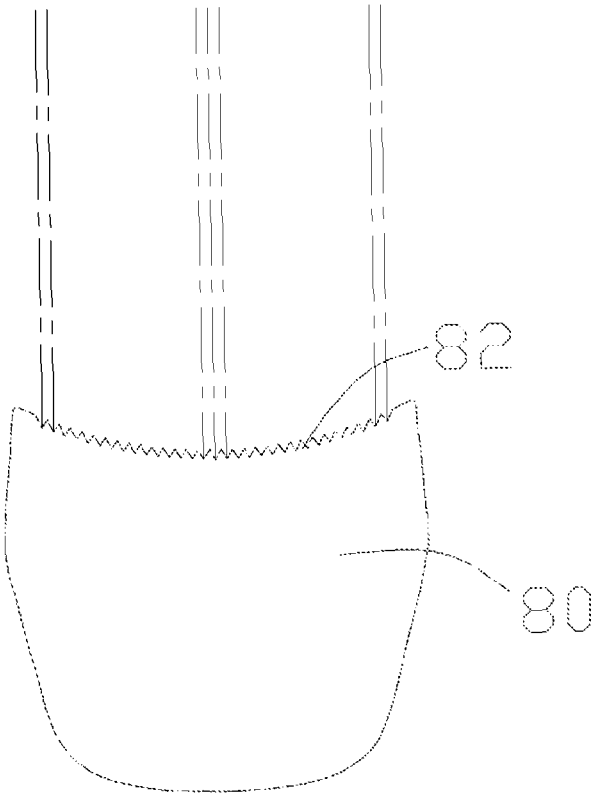
FIG. 7 is a structural view showing the small teeth of the fixed blade toothed edge.

As shown in FIG. 1 to FIG. 7, an embodiment of the concaved cutter head assembly for hair trimmer comprises a fixed blade seat 10, a spring shaft 20, a spring 30, a blade pressing rack 40, a movable blade rack 50, a movable blade 60, a slot support 70 and a fixed blade 80.

The fixed blade 80 and the movable blade 60 are being stacked up and are mutually fixed in position with respect to each other. The fixed blade 80 and the movable blade 60 comprise a fixed blade toothed edge 82 and a movable blade toothed edge 62 respectively and each of the fixed blade toothed edge 82 and the movable blade toothed edge 62 is constituted by a multiple number of consecutively arranged small teeth each having a cutting edge on each of its two sides. The movable blade toothed edge 62 is concealed by the fixed blade toothed edge 82. The slot support 70 is disposed between the fixed blade 80 and the movable blade 60. The slot support 70 is fixed with the fixed blade 80. Two fixing holes 61 are provided on the movable blade 60. The movable blade rack 50 is fixed on a second side of the movable blade 60 opposing to a first side of the movable blade 60 which faces towards the slot support 70. The movable blade rack 50 is provided with two mounting columns 51 corresponding to the two fixing holes 61. The two mounting columns 51 pass through the corresponding two fixing holes 61 and extend into two corresponding slots 71 on the slot support 70.

The fixed blade seat 10 and the fixed blade 80 are mutually fixed with respect to each other via screws 90. The movable blade rack 50, the movable blade 60, the slot support 70, the spring 30 and the blade pressing rack 40 are all disposed between and accommodated within a space between the fixed blade seat 10 and the fixed blade 80. A motion actuating rod 52 is disposed on a surface of the movable blade rack 50. An opening 11 is provided on the fixed blade seat 10 at a position corresponding to where the motion actuating rod 52 is positioned. The motion actuating rod 52 is exposed via the opening 11 so that the motion actuating rod 52 can be driven by a driving device inside the hair trimmer, thereby driving the movable blade toothed edge 62 to move reciprocally along the slots 71 with respect to the fixed blade toothed edge 82 to form a cutting surface.

One end of the spring 30 is fixed to an end of the fixed blade seat 10 opposite to the cutting surface via the spring shaft 20. Another end of the spring 30 presses the movable blade 60 tightly against the fixed blade 80 via the blade pressing rack 40 so as to prevent hairs from slipping into any space between the movable blade 60 and the fixed blade 80.

Another end of the fixed blade seat 10 corresponding to the fixed blade toothed edge 82 is provided with a protective cover 12. A frontal edge of the protective cover 12 is positioned in front of the fixed blade toothed edge 82. The protective cover 12 is provided firstly for skin stretching and straightening to prevent bulging and thereby preventing the skin from being cut and hurt, and secondly for limiting the height difference between the skin and the cutting blades, whereas the optimum height difference is that the skin and the cutting blades are nearly on the same height level because bulging skin may easily get cut and hurt.

The fixed blade toothed edge 82, the movable blade toothed edge 62, the slots 71 and the frontal edge of the protective cover 12 are all concave arcs in terms of their shape, and all the concave arcs are concentric with respect to one another, whereas radius of a respective concave arc of the frontal edge of the protective cover 12 is smaller than radius of a respective concave arc of the fixed blade toothed edge 82, the radius of the respective concave arc of the fixed blade toothed edge 82 is smaller than radius of a respective concave arc of the movable blade toothed edge 62, the radius of the respective concave arc of the movable blade toothed edge 62 is smaller than radius of a respective concave arc of the slots 71. The concave arcs are arranged as above in order to fix a depth in the cutter head assembly where trimming by the blades is performed so as to optimize hair trimming effect, and to ensure that tips of the small teeth of the movable blade 60 are behind the fixed blade 80 so as not to cut and hurt the skin.

Width of the opening 11 is larger than width of the motion actuating rod 52 so that on one hand the motion actuating rod 52 can move reciprocally when it is driven, and on the other hand two ends of the movable blade 60 will not be moved past two ends of the fixed blade 80 and will not be exposed therefrom when the motion actuating rod 52 drives the movable blade toothed edge 62 to move reciprocally along the slots 71 with respect to the fixed blade toothed edge 82.

The juxtaposed tips of both the small teeth of both the fixed blade toothed edge 82 and the movable blade toothed edge 62 are all pointing forward towards one and the same direction. Accordingly, the small teeth are not symmetrical, and this kind of structure enables the small teeth to be made by a single process using a milling wheel or a grinding wheel. As such, the small teeth are made with accurate measurements, good quality and low production cost.

Thickness of the fixed blade toothed edge 82 is not more than 0.3 mm.

A washing hole 13 is provided on the fixed blade seat 10 near to the cutting surface to allow inlet of water so as to wash and clean the cutting surface.

The above description is intended to describe, in a specific and detailed manner, only some ways of implementing the present invention. The above description is not intended to limit the scope of the present invention. It should be noted that, any change and modification made by a person skilled in this field of art without deviating from the inventive concept of the present invention should fall within the scope of protection of the present invention. The scope of protection of the present invention is defined by the appended claims.

What is claimed is:

1. A concaved cutter head assembly for hair trimmer comprising a fixed blade and a movable blade stacked up and mutually fixed in position with respect to each other, and a slot support having slots disposed between the fixed blade and the movable blade and fixed to the fixed blade; wherein the fixed blade and the movable blade comprise a fixed blade toothed edge and a movable blade toothed edge respectively and each of the fixed blade toothed edge and the movable blade toothed edge is constituted by a multiple number of consecutively arranged small teeth each having a cutting edge on each of its two sides; the movable blade toothed edge is concealed by the fixed blade toothed edge; the movable blade is driven so that the movable blade toothed edge moves reciprocally with respect to the fixed bladed toothed edge to form a cutting surface; the concaved cutter head assembly for hair trimmer also comprises a fixed blade seat; the fixed blade seat is positioned corresponding to the fixed blade; a spring is disposed within a space between the fixed blade seat and the fixed blade; the fixed blade seat has a first end provided with a protective cover whose frontal edge is positioned in front of the fixed blade toothed edge for protecting the fixed blade toothed edge and for stretching and smoothing a skin surface before the movable blade starts hair cutting and trimming, and a second end fixed with one end of the spring via a spring shaft, whereas the first of the fixed blade seat corresponds to the fixed toothed edge and the second end of the fixed blade seat is opposite to the cutting surface; the movable blade and the slot support are disposed between and accommodated within the space between the fixed blade seat and the fixed blade; the fixed blade tooth edge, the movable blade toothed edge, the slots and the frontal edge of the protective cover are all concave arcs in terms of their shape, and all these concave arcs are concentric with respect to one another.

2. The concaved cutter head assembly for hair trimmer as in claim 1, wherein radius of a respective concave arc of the frontal edge of the protective cover is smaller than radius of a respective concave arc of the fixed blade toothed edge, the radius of the respective concave arc of the fixed blade toothed edge is smaller than radius of a respective concave arc of the movable blade toothed edge, the radius of the respective concave arc of the movable blade toothed edge is smaller than radius of a respective concave arc of the slots.

3. The concaved cutter head assembly for hair trimmer as in claim 2, wherein the concaved cutter head assembly for hair trimmer also comprises a movable blade rack accommodated within the space between the fixed blade seat and the fixed blade and fixed on a second side of the movable blade; the second side of the movable blade opposes to a first side of the movable blade whereas the first side is a side that faces towards the slot support; fixing holes are provided on the movable blade; the movable blade rack is provided with mounting columns; the mounting columns pass through the fixing holes and extend into the slots on the slot support to be movable reciprocally along the slots; the movable blade rack is driven to drive the movable blade toothed edge to move reciprocally along the slots with respect to the fixed blade toothed edge.

4. The concaved cutter head assembly for hair trimmer as in claim 3, wherein a motion actuating rod is disposed on a surface of the movable blade rack; an opening is provided on the fixed blade seat at a position corresponding to where the motion actuating rod is positioned; the motion actuating rod is exposed via the opening; width of the opening is larger than width of the motion actuating rod so that the motion actuating rod is capable of moving reciprocally within a given range when it is driven while not allowing two ends of the movable blade to be moved past two ends of the fixed blade and not be exposed therefrom when the motion actuating rod drives the movable blade toothed edge to move reciprocally along the slots with respect to the fixed blade toothed edge.

5. The concaved cutter head assembly for hair trimmer as in any one of claims 1-4, wherein juxtaposed tips of both the small teeth of both the fixed blade toothed edge and the movable blade toothed edge are all pointing forward towards one and the same direction; the small teeth are not symmetrical.

6. The concaved cutter head assembly for a hair trimmer as in claim 5, wherein thickness of the fixed blade toothed edge is not more than 0.3 mm.

7. The concaved cutter head assembly for hair trimmer as in claim 1, wherein a blade pressing rack is also disposed within the space between the fixed blade seat and the fixed blade; another end of the spring presses the movable blade tightly against the fixed blade via the blade pressing rack so as to prevent hairs from slipping into any space between the movable blade and the fixed blade.

8. The concaved cutter head assembly for hair trimmer as in claim 1, wherein a washing hole is provided on the fixed blade seat near to the cutting surface.

* * * * *